US005596891A

United States Patent [19]

Bae et al.

[11] Patent Number: 5,596,891

[45] Date of Patent: Jan. 28, 1997

[54] APPARATUS FOR UNTWISTING CLOTHES IN AN AUTOMATIC WASHER

[75] Inventors: Sang C. Bae; Jae R. Park; Jong C. Son, all of Suwon, Rep. of Korea

[73] Assignee: Samsung Electronics Co., Ltd., Suwon, Rep. of Korea

[21] Appl. No.: 525,183

[22] Filed: Sep. 8, 1995

[30] Foreign Application Priority Data

Sep. 15, 1994 [KR] Rep. of Korea ..... 24005
May 8, 1995 [KR] Rep. of Korea ..... 11142

[51] Int. Cl.[6] ..... D06F 37/30

[52] U.S. Cl. ..... 68/133; 68/134

[58] Field of Search ..... 68/131, 132, 133, 68/136; 8/159; 74/89, 99 R

[56] References Cited

U.S. PATENT DOCUMENTS

| | | | |
|---|---|---|---|
| 2,159,271 | 5/1939 | Janda | 68/134 |
| 3,025,690 | 3/1962 | Lathuy | 68/134 |
| 3,399,552 | 9/1968 | Salisbury et al. | 68/134 |
| 3,401,540 | 9/1968 | Platt et al. | 68/134 |
| 3,503,086 | 3/1970 | Mason et al. | 68/134 |
| 3,511,067 | 5/1970 | Matzen | 68/134 |
| 3,651,672 | 3/1972 | Salisbury et al. | 68/134 |

*Primary Examiner*—Frankie L. Stinson
*Attorney, Agent, or Firm*—Burns, Doane, Swecker & Mathis, L.L.P.

[57] ABSTRACT

A clothes washer includes a pulsator which oscillates about a vertical axis. As the pulsator oscillates, a displacement mechanism reciprocates a plurality of thrusters from radially retracted positions adjacent the axis to radially extended positions in order to push the clothes outwardly. The displacement mechanism is driven by the same mechanism that oscillates the pulsator.

14 Claims, 11 Drawing Sheets

APPARATUS FOR UNTWISTING CLOTHES IN AN AUTOMATIC WASHER

BACKGROUND OF THE INVENTION

This invention relates to a clothes washing machine, and more particularly to a clothing untwisting apparatus for automatic washing machines.

Generally, in washing machines, a pulsator is rotated by a drive motor after water as well as detergent has been supplied into a water tub, thereby generating a stream of water to accomplish the washing process. That is, as water and wash articles are rotated by the rotation of the pulsator, circulation of the water and detergent through wash articles or between wash articles occurs to clean the wash articles.

During the washing mode, the pulsator is rotated in a forward or backward direction regularly so as to wash the whole portion of wash articles effectively. Subsequently, a spin mode in which the barrel is rotated at high speed to dehydrate the wet wash articles.

More recently, a washing machine having a heater and a blowing fan has been developed, which has a drying function which supplies hot air to the wash articles. That is, when the heater and the fan are activated, hot air is forcedly blown into the water tub so that all the moisture is removed from the wash articles.

Therefore, the wet wash articles are dried and humid air is discharged to the exterior. In the meantime, the pulsator is intermittently rotated in a forward or backward direction so that the whole portion of wash articles is exposed to the hot air, thereby shortening the drying time.

However, when washing is accomplished using a conventional washing machine, wash articles are severely tangled, which damages wash articles and results in a poor washing function. The tangle or twist of the wash articles normally is caused by the rapid stream of water developed by the rotation of the pulsator.

That is, as the pulsator rotates in a forward direction, centrifugal force applied to the water and wash articles causes the water and the wash articles to rotate in a direction toward the vertical wall of the water tub. The stream directed to the wall turns and returns to the center of the water tub. Part of the stream directed to the wall flows upward along the wall of the water tub and then flows downward toward the center of the water tub. Owing to the rapid stream tendency, wash articles gather in the central portion of the water and become tangled with each other. Furthermore, as the pulsator is rotated in a backward direction, the direction of the stream is abruptly changed, so the speed and the direction of water is diversely divided. Thus, it leads to serious twisting of wash articles.

Owing to the repeated forward and backward directions of the pulsator, more serious twisting of wash articles occurs to diminish the efficiency of washing and even causes damage to the wash articles.

In the condition of tangled wash articles, when the pulsator and the water tub are rotated at high speed to perform the dehydration, the worst tangling of the wash articles occurs.

Further, during the drying process of the tangling condition of the wash articles, the amount of exposed surface of the wash articles to hot air is lessened, resulting in a decrease of drying efficiency.

SUMMARY OF THE INVENTION

An object of the present invention is to provide a wash articles untwisting apparatus for automatic washing machines which prevents tangling and damage of wash articles to increase the efficiency of both washing and drying.

In accordance with the advantageous features of the present invention, the wash articles untwisting apparatus for automatic washing machines comprises a water tub provided in a body, a pulsator being oscillatably mounted in the water tub for generating a stream of water, a drive shaft connected to the pulsator, a motor for supplying rotation force to the shaft, and further a wash articles untwisting apparatus placed on the pulsator.

The wash articles untwisting apparatus is comprised of a bearing member formed integrally at the upper center of the pulsator and having an extending-through hole at the center thereof, and the hole receiving the shaft; a housing freely mounted in the bearing member and having a plurality of openings at the vertical wall; a rotating shaft engaging in the hole, which is rotated by the drive shaft; a motion convertible means being rotated by the shaft for transforming rotational motion into reciprocal motion; and a plurality of thrusters reciprocated through the openings by the operation of the motion convertible means, thereby pushing wash articles concentrated in the center of the water tub outward.

In the first embodiment, the motion convertible means comprises a first link horizontally extended toward the vertical wall of the housing from the upper portion of the rotating shaft, a second link parallelly arranged above the first link, a third link parallelly arranged above the second link, a first shaft perpendicularly provided between respective ends of the first and second links, a second shaft perpendicularly provided between respective other ends of the second and third links and placed opposite to the first shaft, and a third shaft connected to one end of the third link with one end thereof and slidingly engaged with a cavity formed in the inner upper surface of the housing.

Further, the plurality of thrusters comprises a first thruster and a second thruster reciprocated through respective openings by the links rotating along the rotation of the rotating shaft, the first thruster having one end fixed between the first and second links by the first shaft and the other free end reciprocated toward the exterior of the housing.

Furthermore, a ball is disposed between the cavity of the housing and the third shaft, thereby reducing the friction between the housing and the motion convertible means and increasing the rotational motion of the motion convertible means effectively.

Next, the thruster is formed almost trapezoid for pushing upward the a stream of water with the downward incline of the thruster and pushing wash articles outward and upward for the rollover of wash articles during the rotation of the thrusters.

In the second embodiment, the motion convertible means comprises a first and second offset cam provided on the rotating shaft with a different height and extended in opposite directions; and a plurality of thrusters reciprocated through the openings by the operation of the cams, thereby pushing wash articles concentrated in the center of the water tub outward.

Further, the plurality of thrusters comprises a first and second thrusters contacted with the first and second offset cams.

DETAILED DESCRIPTION OF THE PREFERRED EMBODIMENT

A first embodiment of the present invention is illustrated in FIGS. 1–5.

Figure 1:
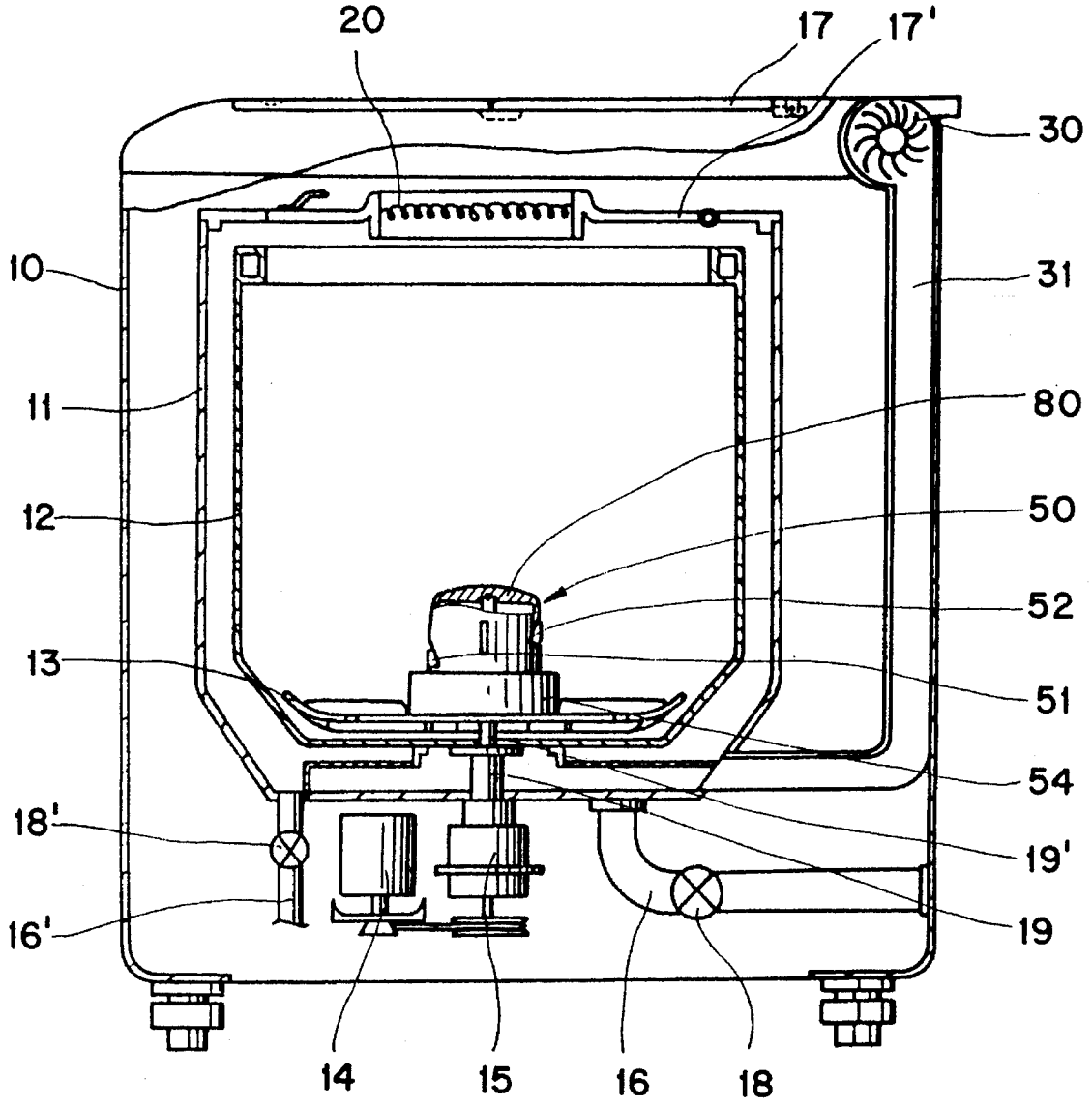
FIG. 1 is a vertical cross-sectional view of a wash articles washing machine according to the present invention.

A wash articles untwisting apparatus 50 for an automatic washing machines embodying the principles of the present invention is depicted in FIG. 1. A water tub 11 is provided in a body 10 of the washing machine. In the water tub 11 there is a spin barrel 12 which is rotatably mounted. At the bottom of the spin barrel 12 a pulsator 13 is mounted for oscillation.

Below the bottom of the water tub 11, there are a motor 14 for rotating both the spin barrel 12 and pulsator 13, and a power transmission apparatus 15 for selectively transmitting the rotating force of the motor 14 to the spin barrel 12 or the pulsator 13 via drive shafts 19,19'.

Respective covers 17,17' are placed on openings of the body 10 and water tub 11 for permitting access into the spin barrel 12. In the inner cover 17' there is installed a heater 20 for drying wash articles. A fan 30 is provided at a predetermined upper area of the body 10. One end of an outlet pipe 31 is interconnected with the fan, while another end thereof is connected with the bottom of the water tub 11, for blowing hot humid air in the water tub 11 to the peripheral area out of the body 10.

Further, at the bottom of the water tub 11 a drain hose 16 and drain valve 18 are provided for discharging water in the water tub 11 to the exterior of the body 10, and an additional drain hose 16' and drain valve 18' are provided for discharging stagnant water in the bottom of the outlet pipe 31.

On the pulsator 13 in the above structured washing machine a wash articles untwisting apparatus 50 embodying the principles of the present invention is mounted.

Figure 2:
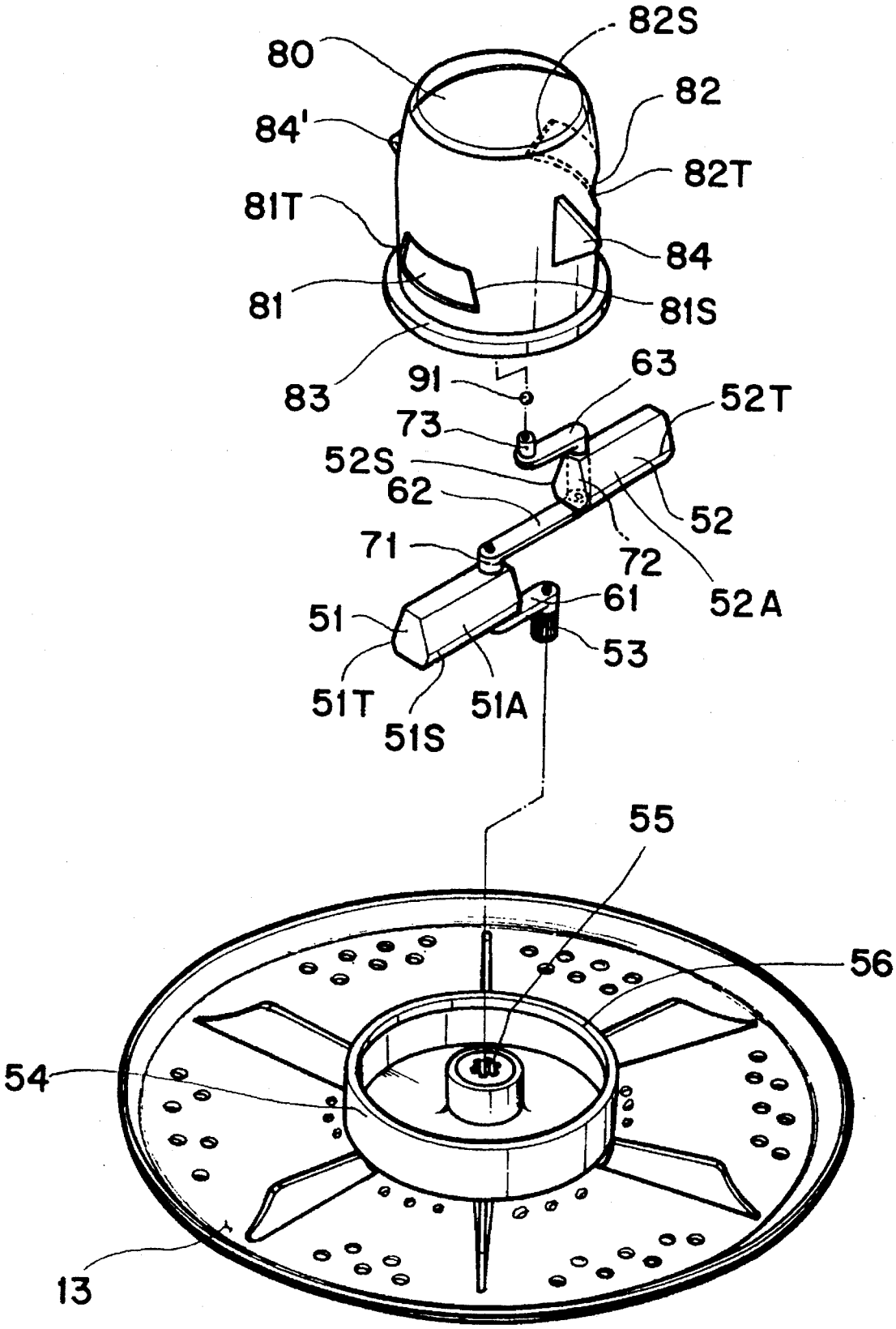
FIG. 2 is an exploded perspective view of the wash articles untwisting apparatus for automatic washing machines according to a first embodiment of the invention.

The wash articles untwisting apparatus 50, as shown in FIG. 2, comprises a couple of thrusters 51,52, rotating shaft 53, bearing member 54, a plurality of links 61,62,63, connecting shafts 71,72,73, and housing 80 which houses the above mentioned components. As will be explained, the thrusters 51, 52 are intermittently extended radially to push the wash articles outwardly.

The housing 80, designed with the bottom open like a hollow cylinder, has a couple of almost oblongish openings 81,82 formed at respective opposite portions of a vertical wall thereof, the openings being disposed at different heights. At the bottom end of the housing 80 a first flange or foot 83 extends outwardly.

Figure 3A:
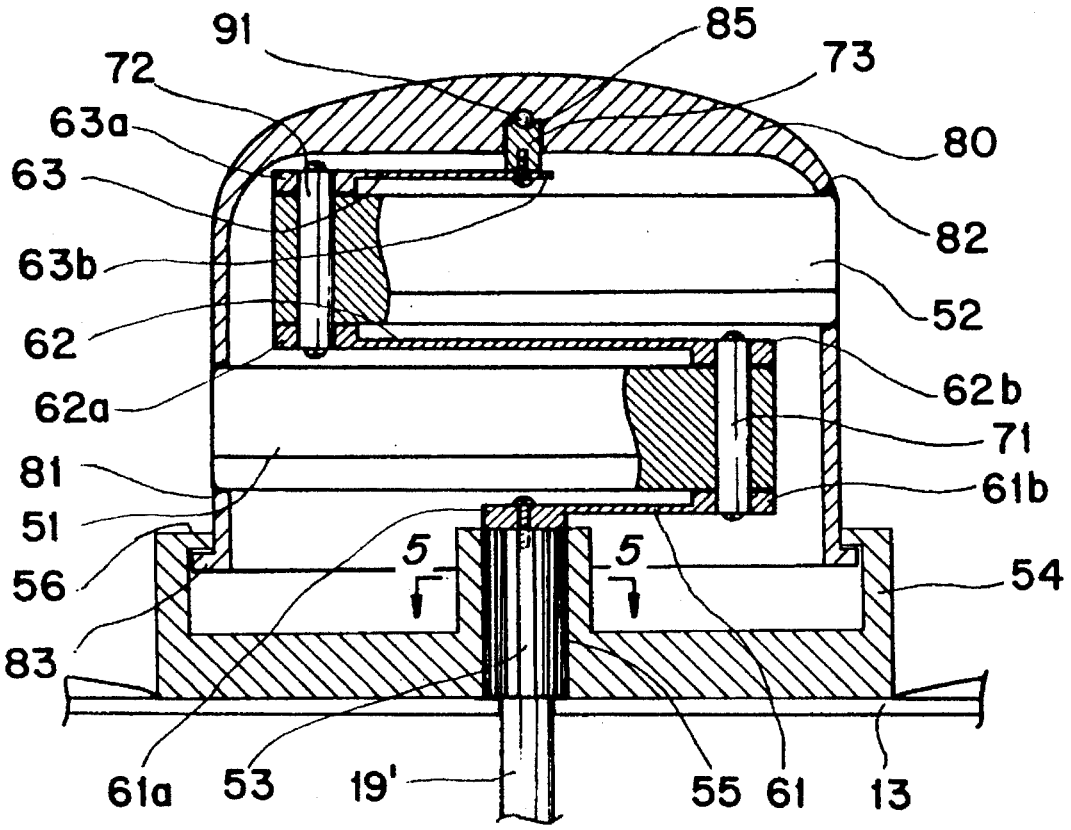
FIGS. 3A and 3B are vertical sectional views of the wash articles untwisting apparatus in retracted and extended positions, respectively.
Figure 4A:
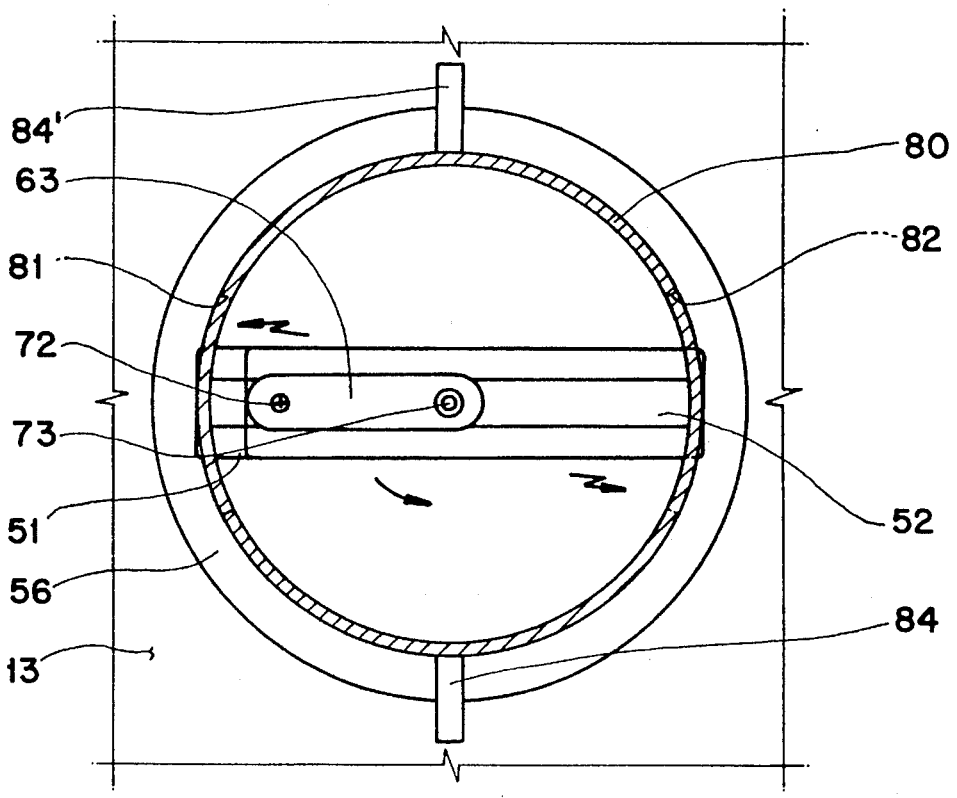
FIGS. 4A to 4D are horizontal sectional views illustrating the operation of the wash articles untwisting apparatus according to the first embodiment.

A couple of stoppers 84,84', as shown in FIG. 4A, are provided on the external wall of the housing 80 perpendicular to a line extending to the centers of openings 81,82. At the internal upper portion of the housing 80 a cavity 85 (FIG. 3A) which is connected to a connecting shaft 73 explained later is provided.

The bearing member 54 is integrally formed on the upper surface of the pulsator 13 and has a through hole 55 at the center thereof. At the upper end of the bearing member 54 an inwardly-extended second flange 56 is provided for assuring complementary contact with the first flange 83 of the housing 80. The links 61,62,63 are arranged in parallel in the housing 80. The first thruster 51 is mounted between the first link 61 and the second link 62 and parallel thereto, and the second thruster 52 is mounted between the second link 62 and the third link 63 and parallel thereto.

The first shaft 71 extends perpendicularly through the second end **61*b* of the first thruster 51, and respective ends of the first shaft 71 are connected to a second end 61*b* of the first link 61 and a second end 62*b* of the second link 62. The second shaft 72, which extends in the opposite direction to the first shaft 71, extends perpendicularly through the rear end of the second thruster 52, and respective ends of the second shaft 72 are connected to a first end 62*a* of the second link 62 and a first end 63*a* of the third link 63. Accordingly, respective leading portions of the first and second thrusters 51,52 are arranged in a reverse direction to each other, i.e. in a 180 degree spacing. The lower end of the third connecting shaft 73 is connected to a second end 63*b* of the third link 63. The upper end of the rotating shaft 53 is connected to the first end 61*a* of the first link 61. The upper end of the third connecting shaft 73 is slidingly provided in the cavity 85 of the housing 80. A ball 91 is provided between the cavity 85 and the third shaft 73 to reduce the friction between the housing 80 and the third shaft 73. The third connecting shaft 73 is coaxially arranged with respect to the rotating shaft 53. As the shaft 53 is rotated when the parts are as shown in FIGS. 3A and 4A, the second ends 61*b*,62*b* of the first and second link 61,62 are rotated in phase difference of 180 degrees with respect to the rotation of the first ends 62*a*,63*a* of the second and third links 62,63 (see FIG. 4B). At this time, the rotation is achieved with the first end 61*a* of the first link 61 and the second end 63*b* of the third link 63** rotatable about a fixed axis.

Since the lower portion of the housing 80 (which housing is supported on the third connecting shaft 73 on the surface contact manner) is arranged at a predetermined distance from the shaft 53, it does not interfere with the rotation of the shaft 53. Further, owing to the engagement of the first and second flanges 83,56 with one another, the housing 80 can not come out of the bearing member 54.

Figure 5:
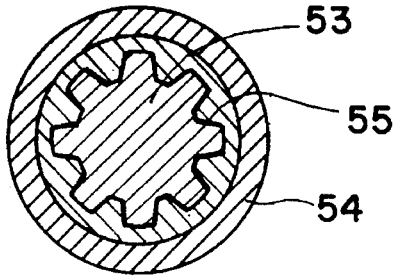
FIG. 5 is a cross-sectional view along line 5—5 of FIG. 3A.

FIG. 3A illustrates the position of the thrusters 51,52 housed in the housing 80. The leading portion of the first thruster 51 is in the first opening 81 of the housing 80, while the leading portion of the second thruster 52 is in the second opening 82 of the housing 80, which thrusters are arranged in opposite directions. A plurality of teeth, as shown in FIG. 5, are formed on the outer periphery of the shaft 53 to be serratedly-assembled with the complementary hole 55 of the bearing member 54. The drive shaft 19' is likewise assembled with the lower portion of the hole 55 to rotate the pulsator 13 and the shaft 53 by the rotation of the drive shaft 19' as shown in FIG. 3A.

The operation of the wash articles untwisting apparatus 50 is shown in FIGS. 3A and 3B, 4A,4B,4C and 4D.

Figure 3B:
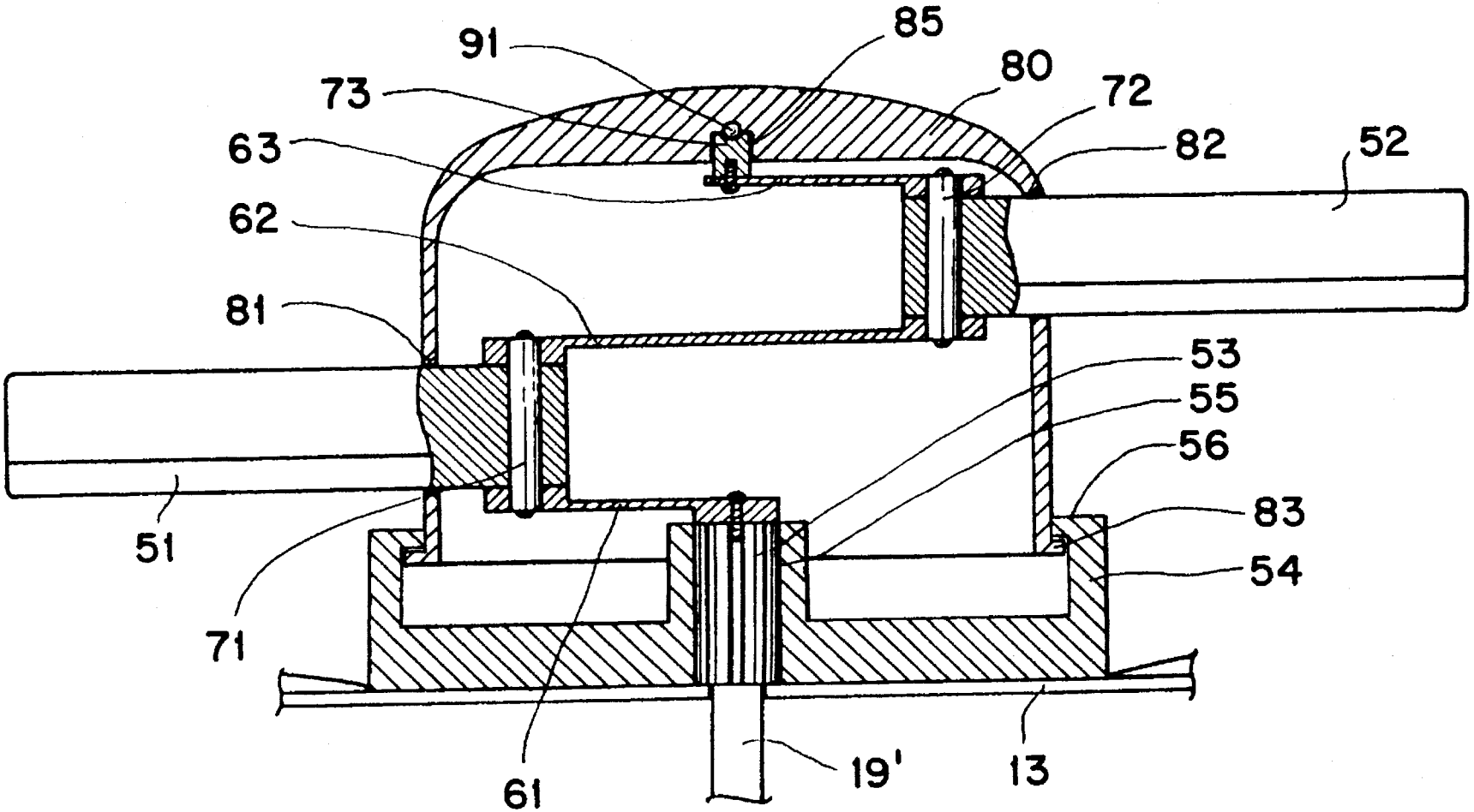
Figure 4B:
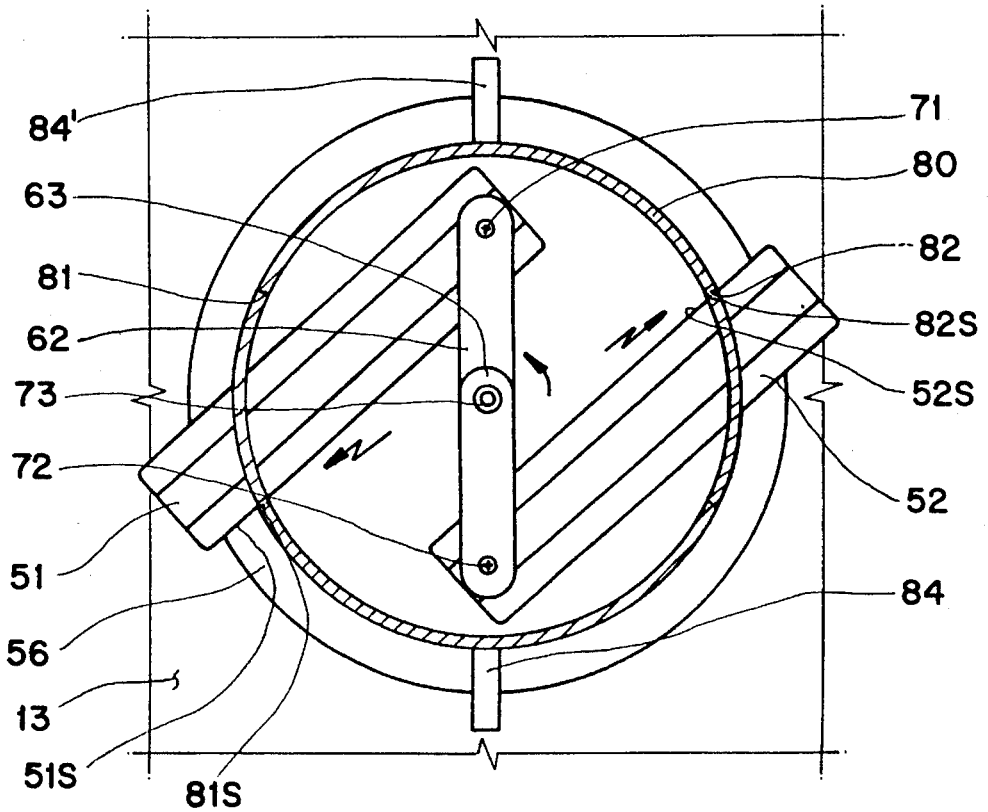
Figure 4C:
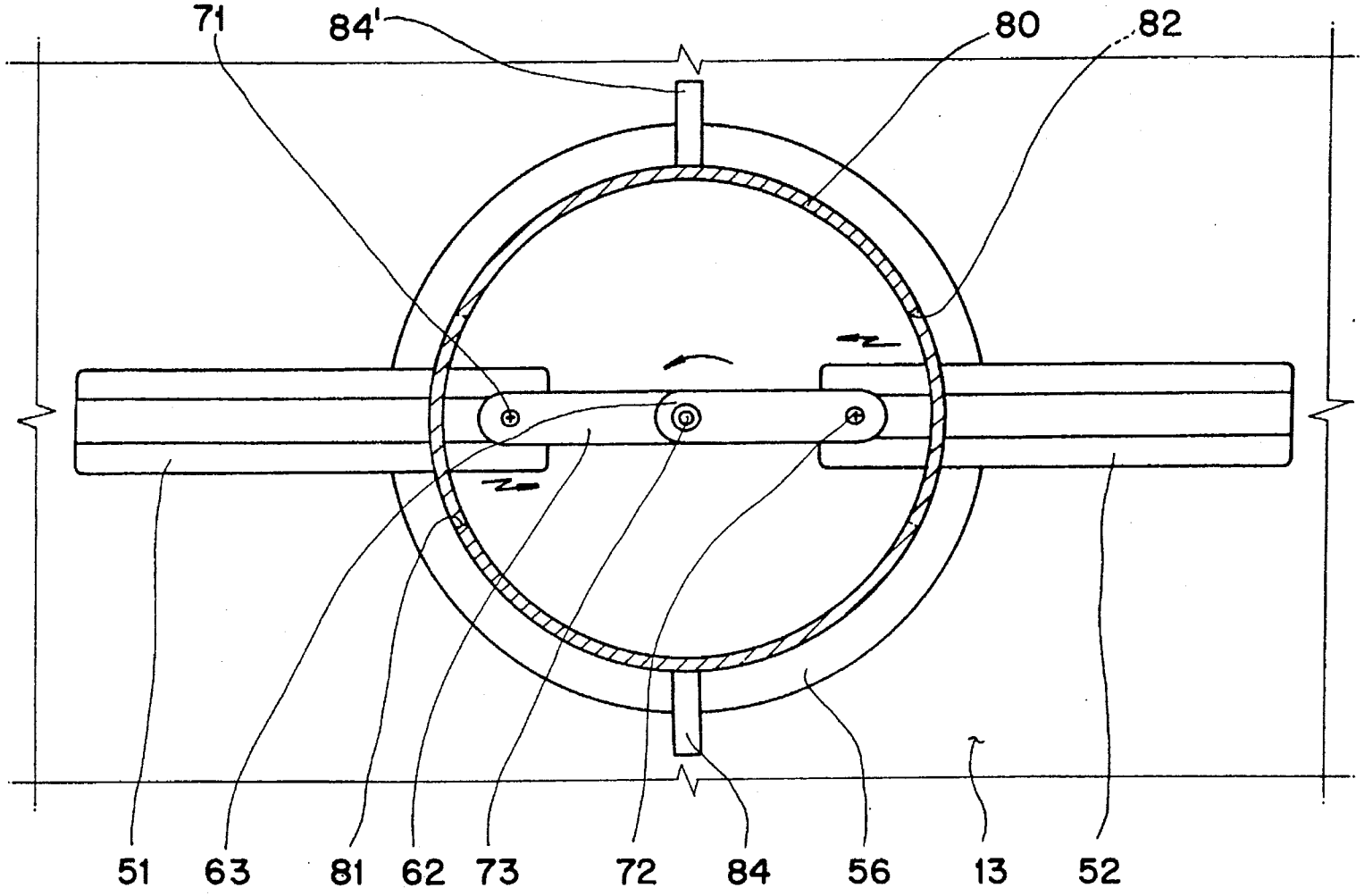
Figure 4D:
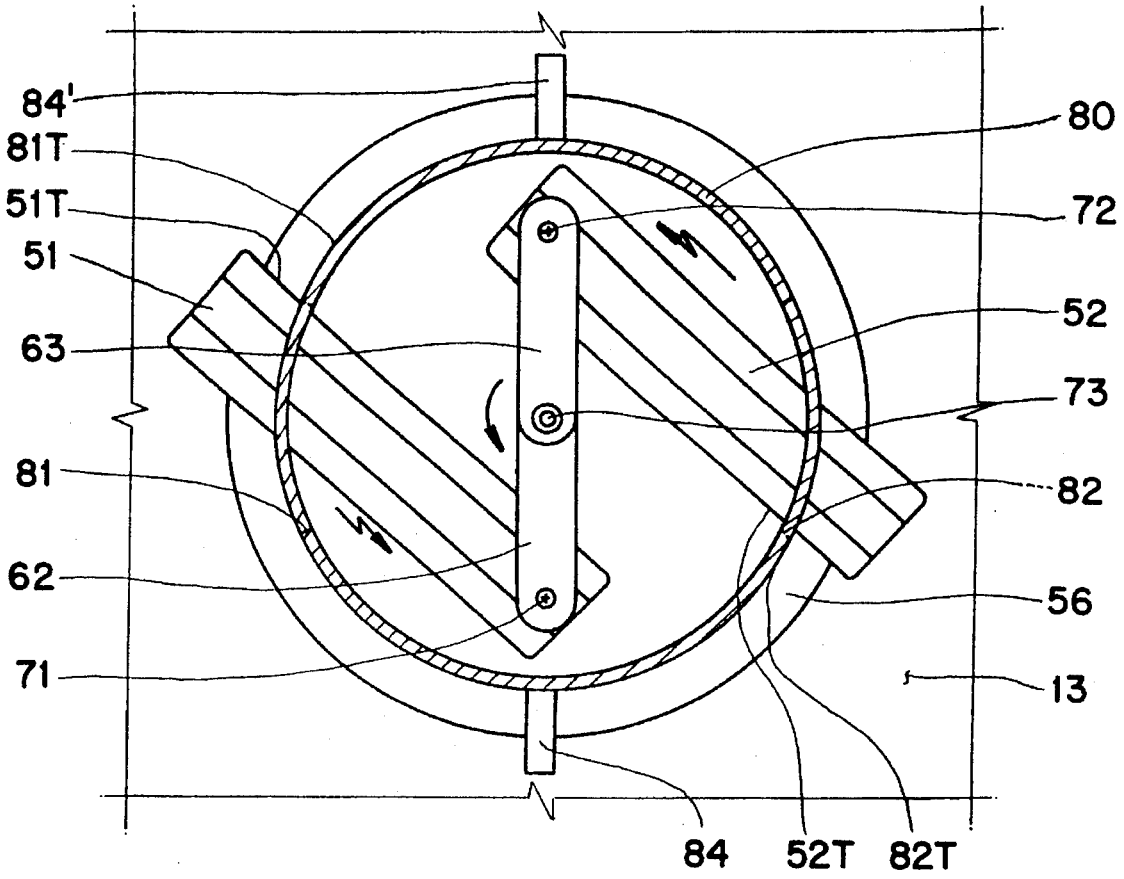

FIGS. 3A and 4A illustrate the positions of the thrusters 51,52 retracted in the housing 80. FIGS. 3B and 4C illustrate the maximal extended positions of the thrusters 51,52 through the openings 81,82 toward the spin barrel 12. FIGS. 4B and 4D illustrate the intermediate positions between FIGS. 3A and 4A and FIGS. 3B and 4C.

Wash articles, washing water, and detergent are put in the water tub 11, and electric power is applied to the motor 14 so that the motor 14 oscillates in the forward and backward directions. The rotation power is transmitted to the pulsator 13 and the shaft 53 via the power transmission apparatus 15 and the drive shaft 19. The pulsator 13 is regularly rotated in the forward and reverse directions to generate a flow of water. Simultaneously, the first link 61 connected to the shaft 53 is rotated. As the rotation of the first link 61, and the second and third links 62,63 integrally assembled by the first and second connecting shafts 71,72 are rotated at a phase difference of 180 degrees.

FIG. 4B illustrates the links 61,62,63 having been rotated by 90 degrees in a counterclockwise direction around the third connecting shaft 73 from the FIG. 4A position. That is, as the links 61,62,63 are rotated in the housing 80, respective side surfaces 51S,52S of thrusters 51,52 contact respective side walls 81S,82S of openings 81,82. Thus, the thrusters 51,52 are moved outward to the exterior of the housing 80. Subsequently, as the links 61,62,63 continue to be rotated in a counterclockwise direction around the third connecting shaft 73 from the position of FIG. 4B to the position of FIG. 4C or 3B, the first and second thrusters 51,52 are extended at a maximum distance toward the vertical wall of the spin barrel 12.

Next, when the links 61,62,63 are further rotated in a counterclockwise direction around the third connecting shaft 73, respective side surfaces 51T,52T of respective thrusters 51,52 contact respective side walls 81T,82T of respective openings 81,82 as shown in FIG. 4D. Thus, the thrusters 51,52 are retracted inward to the interior of the housing 80. Finally, when the links 61,62,63 are furthermore rotated in a counterclockwise direction around the third shaft 73, the links and thrusters are positioned as shown in FIGS. 3A and 4A.

Therefore, by one turn of the shaft 53, the thrusters 51,52 reciprocate one stroke.

According to the reciprocating movement of the thrusters 51,52, the wash articles gathered to the center of the barrel are stuck and pushed toward the inner wall of the spin barrel 12. The washing efficiency is improved and the wash articles tangling problem caused by being gathered at the center of the barrel is prevented.

The thrusters 51,52 are of trapezoidal cross section as shown in FIG. 2, and the downward incline of the surfaces 51A, 52A of the thrusters 51,52 pushes water upwardly. During the rotation of the thrusters 51,52, wash articles are thus pushed outward and upward to be rolled over. Further, when the water flows down along the inner wall of the spin barrel 12, the rotation of the pulsator 13 suspends the wash articles and also pushes them outward again, thus improving the washing efficiency and moreover preventing the tangling of the wash articles effectively.

The housing 80 seldom rotates during the action of the links and the thrusters. The reason for the non-rotation of the housing is as follows. The lower portion of the housing 80 is freely disposed in the bearing member 54, and the upper portion of the housing 80 is seated on the third shaft 73 almost free-friction by the ball 91. Further, a pair of stoppers 84,84' are extended outward from the exterior surface of the housing 80 to create a resistance force in the water which resists rotation of the housing 80.

In other words, when the pulsator 13 and the links 61,62,63 are rotated with the shaft 53, a weak rotational force is transmitted to the housing 80 via the ball 91, but the rotational force can not overcome the friction resistance that is applied to the stoppers 84,84' by the stagnant wash articles and water.

After some period of time, the rotational force can be applied to the stoppers 84,84' as the rotation increases, however, the a stream of water is reversely rotated by the opposite direction of the pulsator 13 and the housing 80 can not be rotated.

Subsequent to the washing process, the pulsator 13 and the spin barrel 12 are rotated at high speed to dehydrate the wet wash articles. Next, the heater 20 and the fan 30 are activated to start the drying process. That is, the exterior air heated through the heater 20 dries the wash articles as humid air is discharged to the exterior through the outlet pipe 31.

During the drying process, the pulsator 13 is slowly rotated and wash articles are rolled over. Also, the first and second thrusters 51,52 are reciprocated to roll wash articles over. Therefore, the direct contact between the wash articles and heated air occurs, thus shortening the drying time.

In this embodiment, a pair of thrusters and connecting shafts are employed, but the effect of the present invention can be increased in that more thrusters and connecting shafts can be installed at a predetermined angle therebetween.

Figure 6:
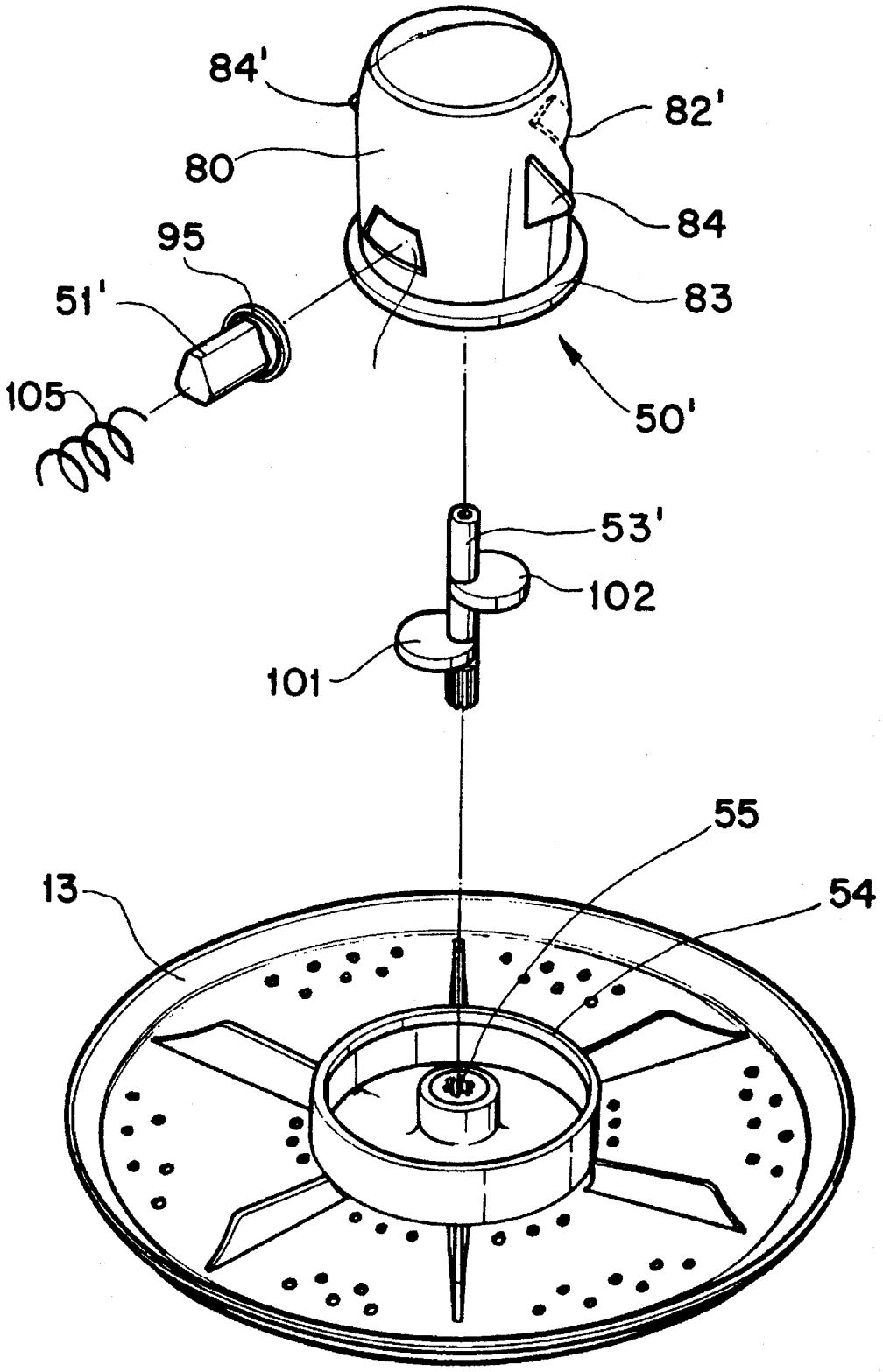
FIG. 6 is an exploded perspective view of the wash articles untwisting apparatus for automatic washing machines according to a second embodiment of the invention.

FIGS. 6 to 8 depict a wash articles untwisting apparatus 50' according to the second embodiment of the present invention. The same component parts of the second embodiment are designated by the same reference numerals as the first embodiment, and therefore will not be explained in greater detail.

The wash articles untwisting apparatus 50' employs a cam for reciprocating the thrusters 51'52' instead of the link system used in the first embodiment. The lower portion of the rotating shaft 53' is serratingly assembled to the hole 55 of the bearing member 54, while the upper portion of the rotating shaft 53' is extended to the inner upper portion of the housing 80, and on the upper portion of the rotating shaft 53' the cavity 85 of the housing 80 is slidingly placed by means of the ball 91.

On the exterior surface of the shaft 53' a pair of plate cams 101,102 are attached to extend in opposite directions. At complementary positions of the housing, openings 81',82' are provided at the corresponding height of the cams 101, 102. The first thruster 51' is arranged between the first cam 101 and the opening 81', while the second thruster 52' is arranged between the second cam 102 and the opening 82'.

At respective rear ends of the thrusters 51',52', disc collar 95 are provided. Around the longitudinal portion of respective thrusters 51',52' are provided elastic means 105,106, one end of which is contacted on the collar 95 and the other thereof is located adjacent to the openings 81',82'. The elastic means is desirably a coil spring, although rubbery material or a plate spring may be employed instead.

The cross-section of the thrusters 51',52' is of trapezoid shape like that of the first embodiment and the function of the thrusters is the same as that of the first embodiment. In the first embodiment, the thrusters 51,52 move in reciprocating motion as well as rotary motion by the operation of the link system, whereas the thrusters 51',52' are operated in only reciprocating motion in the second embodiment. Therefore, the shape of the openings 81',82' is almost the same as the shape of the complementary thrusters 51',52' as shown in FIG. 6, but the size of the openings 81',82' is slightly larger than that of the thrusters 51',52'.

Figure 7A:
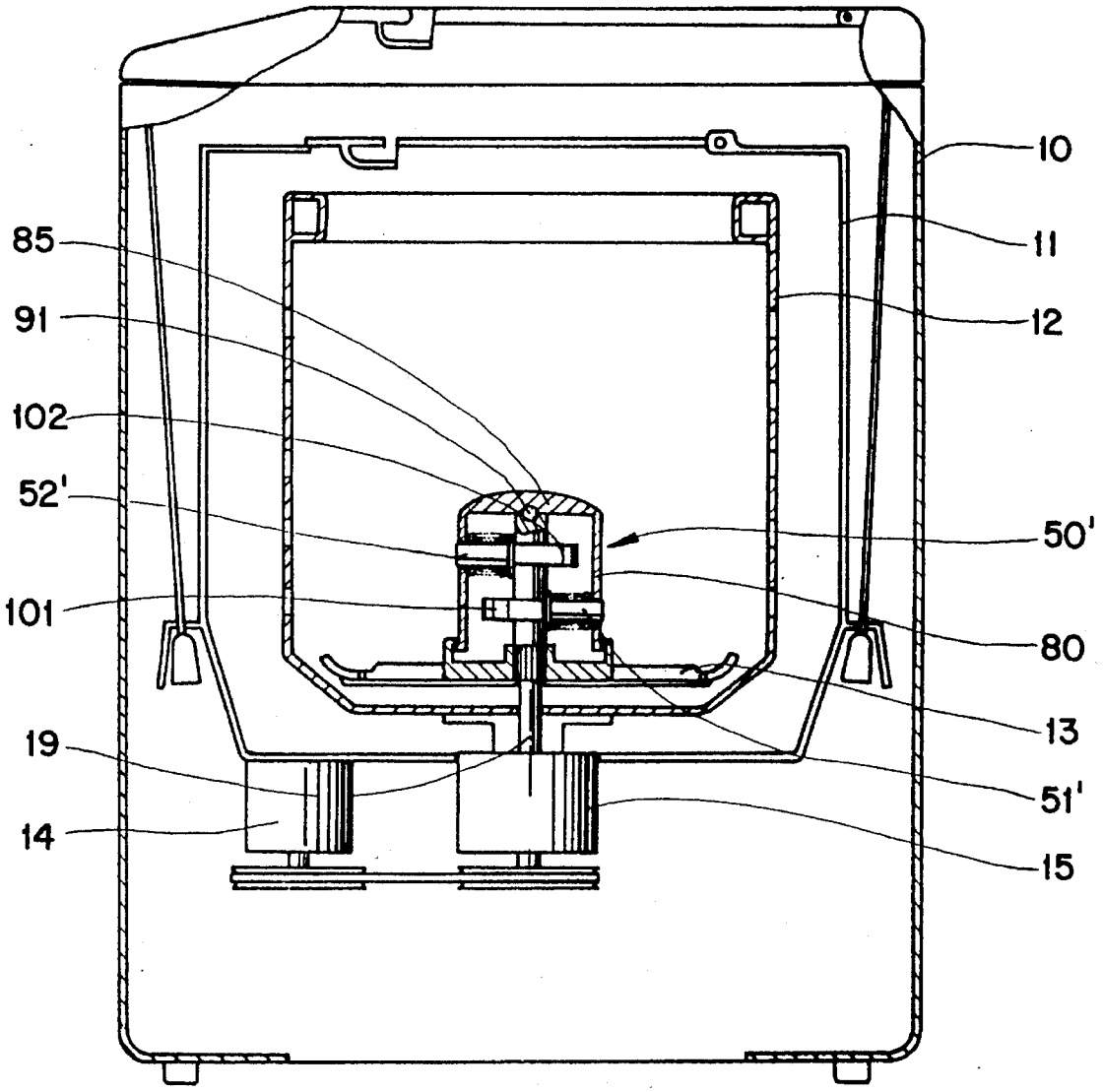
FIGS. 7A and 7B are vertical sectional views of the wash articles untwisting apparatus for automatic washing machines of FIG. 6 in retracted and extended positions, respectively.
Figure 8A:
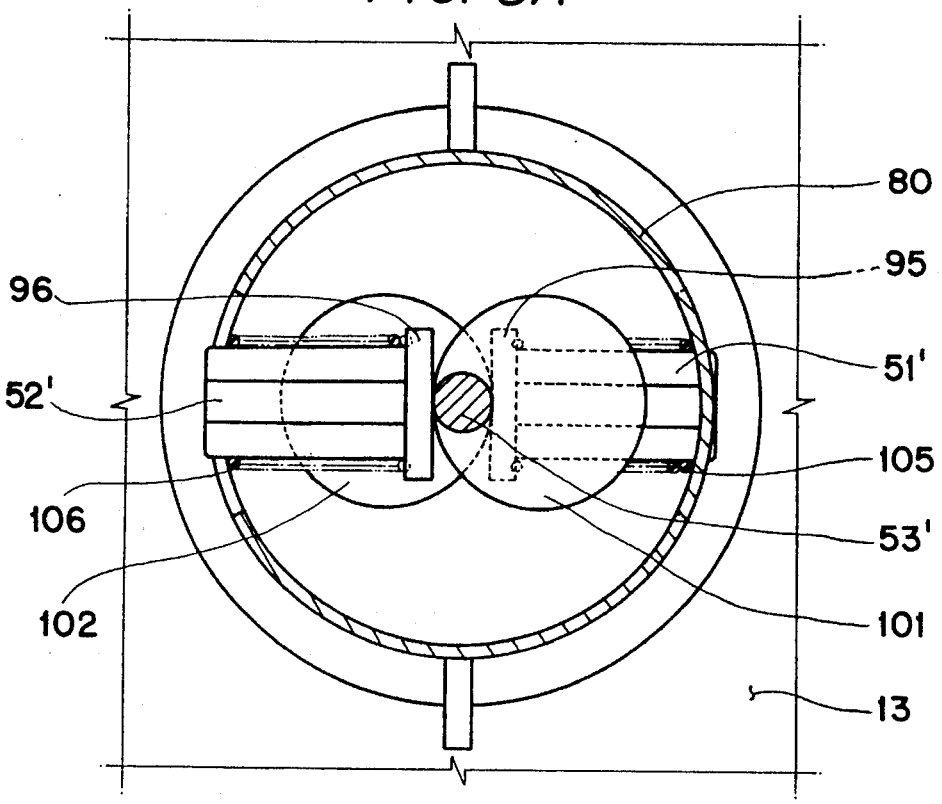
FIGS. 8A to 8B are horizontal sectional views illustrating the operation of the wash articles untwisting apparatus of FIGS. 7A and 7B, respectively.

The operation of the wash articles untwisting apparatus 50' structured above is as follows. In FIGS. 7A and 8A, when the motor 14 drives the first and second thrusters 51',52' retracted in the housing 80, the pulsator 13 is rotated and the rotating shaft 53' is simultaneously rotated in the same direction.

Figure 7B:
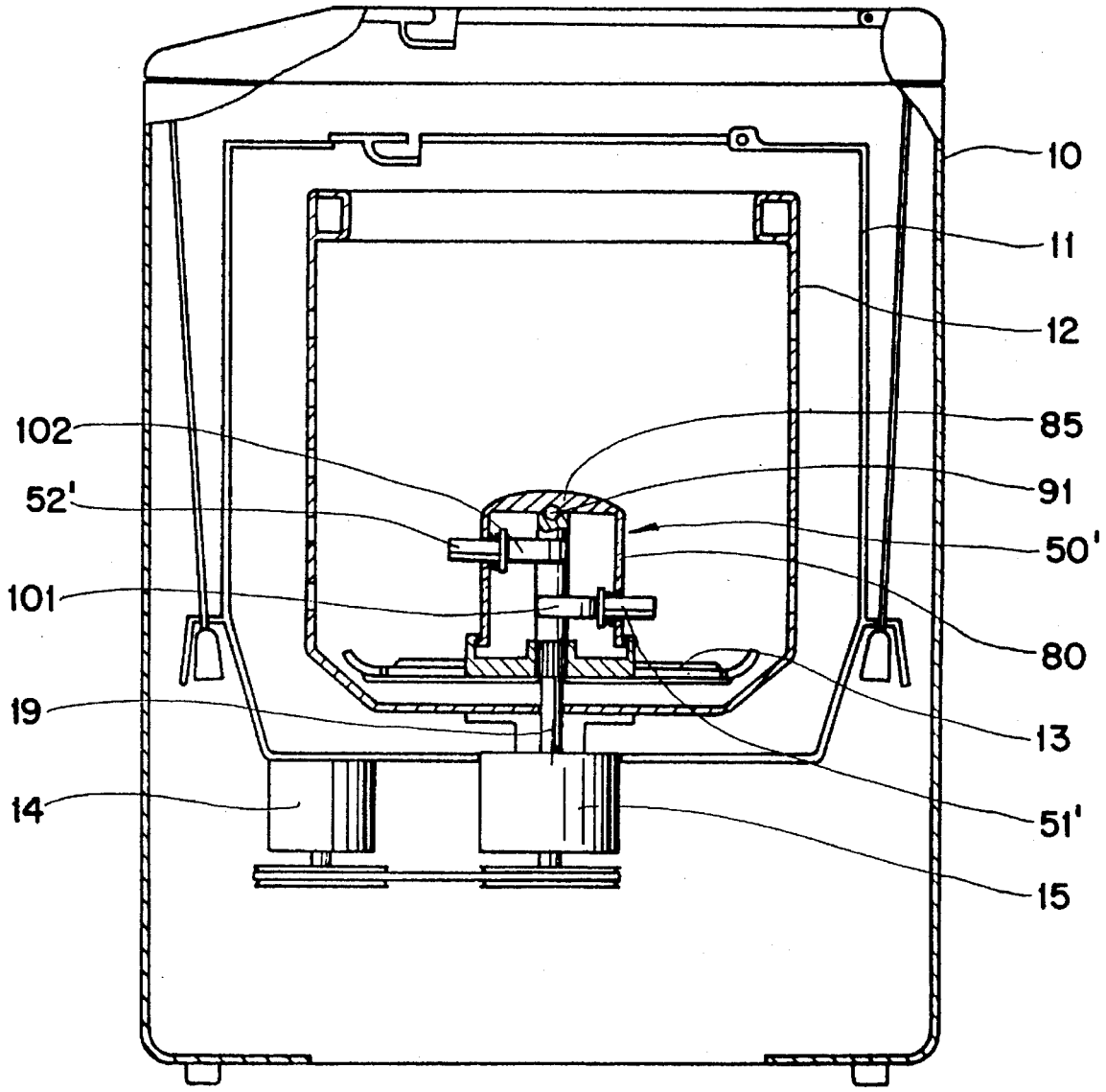
Figure 8B:
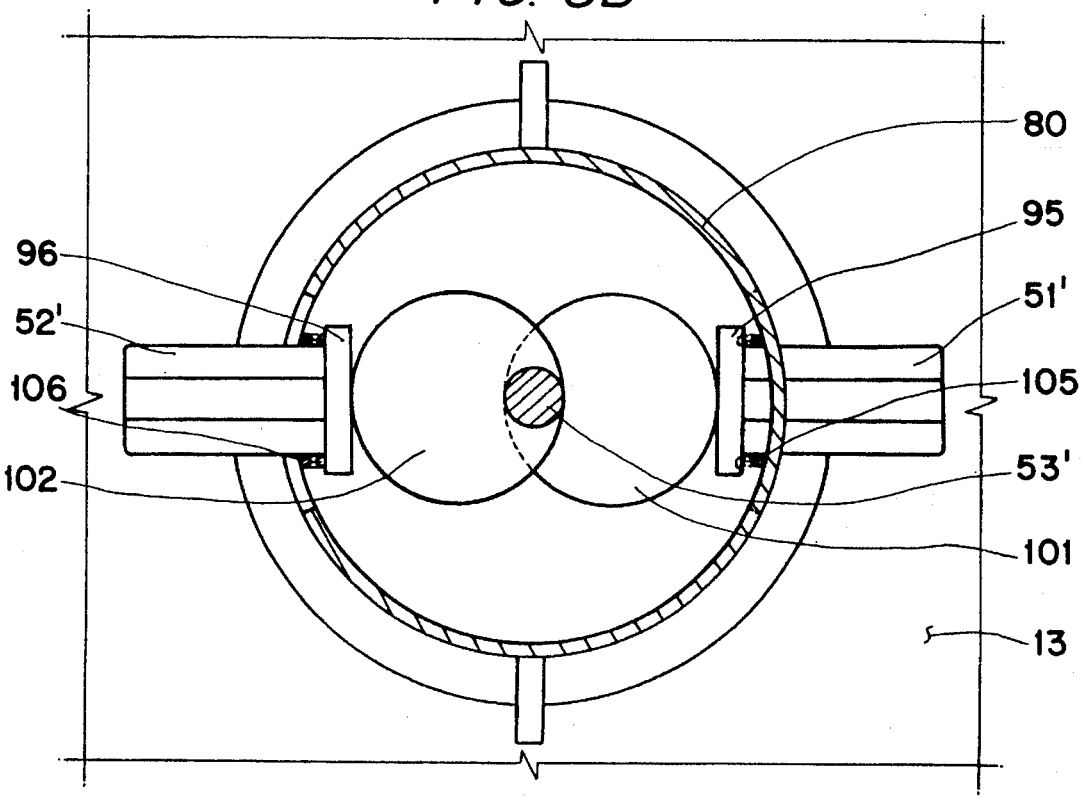

Subsequently, the first and second offset cams 101,102 formed on the shaft 53' are rotated with respect to the rotating shaft 53', and the thrusters 51',52' are pushed toward the exterior of the housing 80. FIGS. 7B and 8B illustrate the maximal extension of the thrusters 51',52' from the housing 80, which are extended by operation of the cams 101,102. At this time, the springs are compressed to a maximum.

After subsequent rotation of the cams 101,102, the thrusters 51',52' are retracted by the elastic force of the springs 105,106 and the position of the thrusters 51',52' is maintained like FIGS. 7A and 8A.

Whenever the shaft 53' is rotated by one turn, the thrusters 51,52 are reciprocated repeatedly in one stroke to push wash articles outward. Therefore, the same function and effect as the first embodiment are attained.

Further, if additional offset cams are provided on the exterior surface of the shaft 53' at evenly spaced distances, the effect of the present invention can be increased more and more. Besides, a couple of thrusters 101,102 could be arranged in a same leading direction to achieve another reciprocal movement. That is, the thruster 51' could be extended a maximal distance toward the inner wall of the spin barrel 12, while the thruster 52' is completely retracted inside of the housing 80.

According to the structure of the wash articles untwisting apparatus, this invention has a variety of advantages as follows.

The twisting or tangling of wash articles is prevented because the wash articles are pushed outward by the reciprocated thrusters during the washing mode. Therefore, damage to wash articles can be prevented. Also, a better washing of wash articles is acquired by the movement of wash articles.

Further, since the upward stream of water along the vertical wall of the water tub due to the rotation of the pulsator subsequently flows downwardly, wash articles are pushed outward, thereby increasing the efficiency of washing more effectively.

Moreover, during the drying process, the wash articles in the water tub are stirred by the thrusters and are exposed to hot air, which leads to reduction of the drying time.

What is claimed:

1. In a wash articles washing machine having a water tub provided in a body, a pulsator being oscillatably mounted in the water tub for generating a stream of water, a wash articles untwisting apparatus placed on said pulsator, a drive shaft connected to the pulsator, and a motor for supplying rotation force to said shaft, said wash articles untwisting apparatus for an automatic washing machines comprising:

a bearing member mounted at the upper center of said pulsator and having an extending-through hole at the center thereof, and said hole receiving said shaft;

a housing freely mounted in said bearing member and having a plurality of openings at the vertical wall;

a rotating shaft engaging in said hole, which is rotated by said drive shaft;

a motion convertible means being rotated by said shaft for transforming rotational motion into reciprocal motion; and a plurality of thrusters reciprocated through said openings by the operation of said motion convertible means, thereby pushing wash articles concentrated in the center of said water tub outward.

2. The wash articles untwisting apparatus for an automatic washing machines according to claim 1, wherein said motion convertible means comprises a first link horizontally extended toward the vertical wall of said housing from the upper portion of said rotating shaft, a second link parallelly arranged above said first link, a third link parallelly arranged above said second link, a first shaft perpendicularly provided between respective ends of said first and second links, a second shaft perpendicularly provided between respective other ends of said second and third links and placed opposite to said first shaft, and a third shaft connected to one end of said third link with one end thereof and slidingly engaged with a cavity formed in the inner upper surface of said housing.

3. The wash articles untwisting apparatus for an automatic washing machines according to claim 2, wherein said plurality of thrusters comprises a first thruster and a second thruster reciprocated through respective openings by said links rotating along the rotation of said rotating shaft, said first thruster having one end fixed between said first and second links by said first shaft and the other free end reciprocated toward the exterior of said housing.

4. The wash articles untwisting apparatus for an automatic washing machines according to claim 2, wherein a ball is disposed between said cavity of housing and said third shaft, thereby reducing the friction between said housing and said motion convertible means and increasing the rotational motion of said motion convertible means effectively.

5. The wash articles untwisting apparatus for an automatic washing machines according to claim 3, wherein said thruster is formed almost trapezoid for pushing upward the a stream of water with the downward incline of said thruster and pushing wash articles outward and upward for the rollover of wash articles during the rotation of said thrusters.

6. The wash articles untwisting apparatus for an automatic washing machines according to claim 1, wherein to transmit the rotation force of said drive shaft to said rotating shaft and pulsator a serration is shaped on said drive shaft and rotating shaft and said hole.

7. The wash articles untwisting apparatus for an automatic washing machines according to claim 1, wherein a couple of stoppers provided at the external wall of said housing are perpendicular to the line extending each enter of said openings, and the rotation of said housing is prevented by resistance generated from the water and wash articles.

8. The wash articles untwisting apparatus for an automatic washing machines according to claim 1, wherein an inwardly-extended first flange is provided at the upper portion of said bearing member and an outwardly-extended second flange is provided at the lower portion of said housing, said first flange engaging with said second flange for preventing unengagement between flanges.

9. In a wash articles washing machine having a water tub provided in a body, a pulsator being oscillatably mounted in the water tub for generating a stream of water, a wash articles untwisting apparatus placed on said pulsator, a drive shaft connected to the pulsator, and a motor for supplying rotational force to said shaft, said wash articles untwisting apparatus for an automatic washing machines comprising:

a bearing member mounted at the upper center of said pulsator and having an extending-through hole at the center thereof, and said hole receiving said shaft;

a housing freely mounted in said bearing member and having a plurality of openings at the vertical wall;

a rotating shaft engaging in said hole, which is rotated by said drive shaft;

a first and second offset cam provided on said rotating shaft with different heights and extended in opposite directions; and a plurality of thrusters reciprocated through said openings by the operation of said cams, thereby pushing wash articles concentrated in the center of said water tub outward.

10. The wash articles untwisting apparatus for an automatic washing machines according to claim 9, wherein the upper end of said rotating shaft is slidingly disposed in a cavity formed in the inner upper surface of said housing.

11. The wash articles untwisting apparatus for an automatic washing machines according to claim 10, wherein a ball is disposed between said cavity of housing and said rotating shaft, thereby reducing the friction between said housing and said rotating shaft and increasing the rotational motion of said rotating shaft effectively.

12. The wash articles untwisting apparatus for an automatic washing machines according to claim 9, wherein said plurality of thrusters comprises first and second thrusters contacting with said first and second offset cams.

13. The wash articles untwisting apparatus for an automatic washing machines according to claim 12, wherein an elastic means is disposed between said thruster and said housing for elastically generating the reciprocal movement of said thrusters.

14. The wash articles untwisting apparatus for an automatic washing machines according to claim 12, wherein said thruster is formed almost trapezoid for pushing upward the a stream of water with the downward incline of said thruster and pushing wash articles outward and upward for the rollover of wash articles during the rotation of said thrusters.

* * * * *